US007405701B2

(12) United States Patent
Ozkar

(10) Patent No.: US 7,405,701 B2
(45) Date of Patent: Jul. 29, 2008

(54) MULTI-BAND BENT MONOPOLE ANTENNA

(75) Inventor: Mete Ozkar, Raleigh, NC (US)

(73) Assignee: Sony Ericsson Mobile Communications AB (SE)

( * ) Notice: Subject to any disclaimer, the term of this patent is extended or adjusted under 35 U.S.C. 154(b) by 272 days.

(21) Appl. No.: 11/239,589

(22) Filed: Sep. 29, 2005

(65) Prior Publication Data

US 2007/0069958 A1 Mar. 29, 2007

(51) Int. Cl.
*H01Q 1/24* (2006.01)

(52) U.S. Cl. ..... 343/702; 343/815; 343/846

(58) Field of Classification Search ..... 343/700 MS, 343/702, 815, 833, 834, 846
See application file for complete search history.

(56) References Cited

U.S. PATENT DOCUMENTS

| | | | | |
|---|---|---|---|---|
| 5,714,937 | A * | 2/1998 | Campana, Jr. | 340/573.1 |
| 6,198,943 | B1 | 3/2001 | Sadler et al. | |
| 6,340,952 | B1 | 1/2002 | Tsai et al. | |
| 6,535,166 | B1 | 3/2003 | Ali | |
| 6,744,409 | B2 | 6/2004 | Ellis et al. | |
| 6,768,461 | B2 | 7/2004 | Huebner et al. | |
| 6,774,853 | B2 | 8/2004 | Wong et al. | |
| 6,819,287 | B2 | 11/2004 | Sullivan et al. | |
| 6,822,610 | B2 | 11/2004 | Yeh | |
| 6,856,285 | B2 | 2/2005 | Bettin et al. | |
| 6,876,329 | B2 | 4/2005 | Milosavljevic | |
| 6,882,318 | B2 | 4/2005 | Nevermann | |
| 7,202,835 | B2 * | 4/2007 | Chiang et al. | 343/834 |
| 2005/0128152 | A1 * | 6/2005 | Milosavljevic | 343/702 |
| 2005/0212706 | A1 * | 9/2005 | Ying et al. | 343/702 |
| 2006/0044187 | A1 * | 3/2006 | Sager et al. | 343/700 MS |

FOREIGN PATENT DOCUMENTS

| | | |
|---|---|---|
| EP | 1 052 723 | 11/2000 |
| EP | 1 396 906 | 3/2004 |
| WO | 02/078124 | 10/2002 |
| WO | 03/094289 | 11/2003 |
| WO | 03/096474 | 11/2003 |

OTHER PUBLICATIONS

Virga et al., "Low-Profile Enchanced-Bandwidth PIFA Antennas for Wireless Communications Packaging," Oct. 1997, pp. 1879-1888, vol. 45, No. 10, XP11036995.
PCT International Search Report, International Application No. PCT/US2006/017711, Mailed Aug. 31, 2006.

* cited by examiner

*Primary Examiner*—Tho G Phan
(74) *Attorney, Agent, or Firm*—Coats & Bennett, P.L.L.C.

(57) ABSTRACT

The method and apparatus described herein improves the bandwidth of a selected frequency band of a multi-band antenna. In particular, a selection circuit selectively applies capacitive coupling to the multi-band antenna to improve the bandwidth of a first frequency band without adversely affecting the bandwidth of a second frequency band. To that end, the multi-band antenna of the present invention comprises a main antenna element and a parasitic element disposed proximate the main antenna element. When the multi-band antenna operates in the first frequency band, the main antenna element capacitively couples to the parasitic element. However, when the multi-band antenna operates in the second frequency band, the selection circuit disables the capacitive coupling. By applying the capacitive coupling only when the multi-band antenna operates in the first frequency band, the present invention increases the bandwidth of the first frequency band without adversely affecting the bandwidth of the second frequency band.

24 Claims, 6 Drawing Sheets

MULTI-BAND BENT MONOPOLE ANTENNA

BACKGROUND

This invention relates generally to wireless communication antennas, and more particularly to multi-band antennas for wireless communication devices.

Wireless communication devices typically use multi-band antennas to transmit and receive wireless signals in multiple wireless communication frequency bands, such as Advanced Mobile Phone System (AMPS), Personal Communication Service (PCS), Personal Digital Cellular (PDC), Global System for Mobile communications (GSM), Code Division Multiple Access (CDMA), etc. A bent monopole antenna represents a common multi-band antenna. While bent monopole antennas typically do not have sufficient bandwidth to cover all desired wireless communication frequency bands, the compact size and multi-band design make them ideal for compact wireless communication devices.

Parasitic elements that improve antenna performance are also known. When applied to multi-band antennas, the parasitic element typically only improves performance in one of the wireless communication frequency bands, but adversely affects the performance of the antenna in the other wireless communication frequency band(s).

SUMMARY

The present invention relates to multi-band antennas for wireless communication devices. The multi-band antenna includes a main antenna element and a parasitic element. When the antenna operates in the first frequency band, a selection circuit connects the parasitic element to ground to capacitively couple the main antenna element to the parasitic element. This capacitive coupling increases the bandwidth of the first frequency band. When the antenna operates in the second frequency band, the selection circuit disables the capacitive coupling. By applying the capacitive coupling only when the antenna operates in the first frequency band, the bandwidth of the first frequency band is increased without adversely affecting the performance of the second frequency band.

According to the present invention, a low impedance connection between the parasitic element and the antenna ground enables the capacitive coupling between the parasitic element and the main antenna element when the antenna operates in the first frequency band. When the antenna operates in the second frequency band, a high impedance connection between the parasitic element and the antenna ground disables the capacitive coupling. The antenna may use a selection circuit, such as a switch, to generate the desired high and low impedance connections. According to another embodiment, the selection circuit may comprise a filter, where the filter has a low impedance responsive to frequencies in the first frequency band, and has a high impedance responsive to frequencies in the second frequency band.

DETAILED DESCRIPTION

Figure 1:
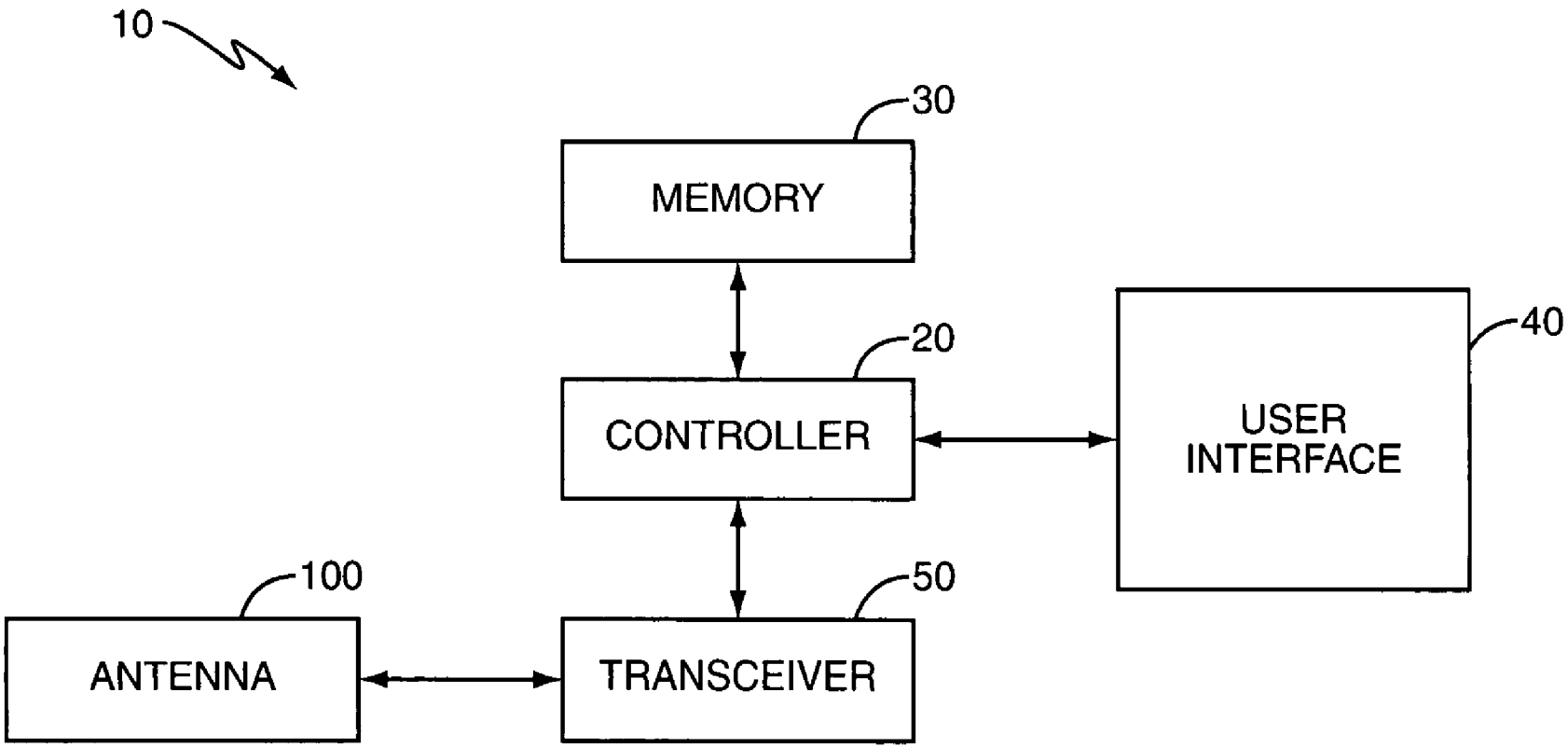
FIG. 1 illustrates a block diagram of a wireless communication device according to the present invention.

FIG. 1 illustrates a block diagram of an exemplary wireless communication device 10. Wireless communication device 10 comprises a controller 20, a memory 30, a user interface 40, a transceiver 50, and a multi-band antenna 100. Controller 20 controls the operation of wireless communication device 10 responsive to programs stored in memory 30 and instructions provided by the user via user interface 40. Transceiver 50 interfaces the wireless communication device 10 with a wireless network using antenna 100. It will be appreciated that transceiver 50 may operate according to one or more of any known wireless communication standards, such as Code Division Multiple Access (CDMA), Time Division Multiple Access (TDMA), Global System for Mobile communications (GSM), Global Positioning System (GPS), Personal Digital Cellular (PDC), Advanced Mobile Phone System (AMPS), Personal Communication Service (PCS), Wideband CDMA (WCDMA), etc.

Multi-band antenna 100 transmits and receives signals according to one or more of the above wireless communication standards. For purposes of illustration, the following describes the antenna 100 in terms of a low frequency wireless communication band and a high frequency wireless communication band. An exemplary low frequency wireless communication band includes an AMPS frequency band (850 MHz) and/or a GSM low frequency band (900 MHz). An exemplary high frequency wireless communication band includes a GSM high frequency band (1800 MHz) and/or a PCS frequency band (1900 MHz). However, it will be appreciated that antenna 100 may be designed to cover additional or alternative wireless communication frequency bands.

Figure 2:
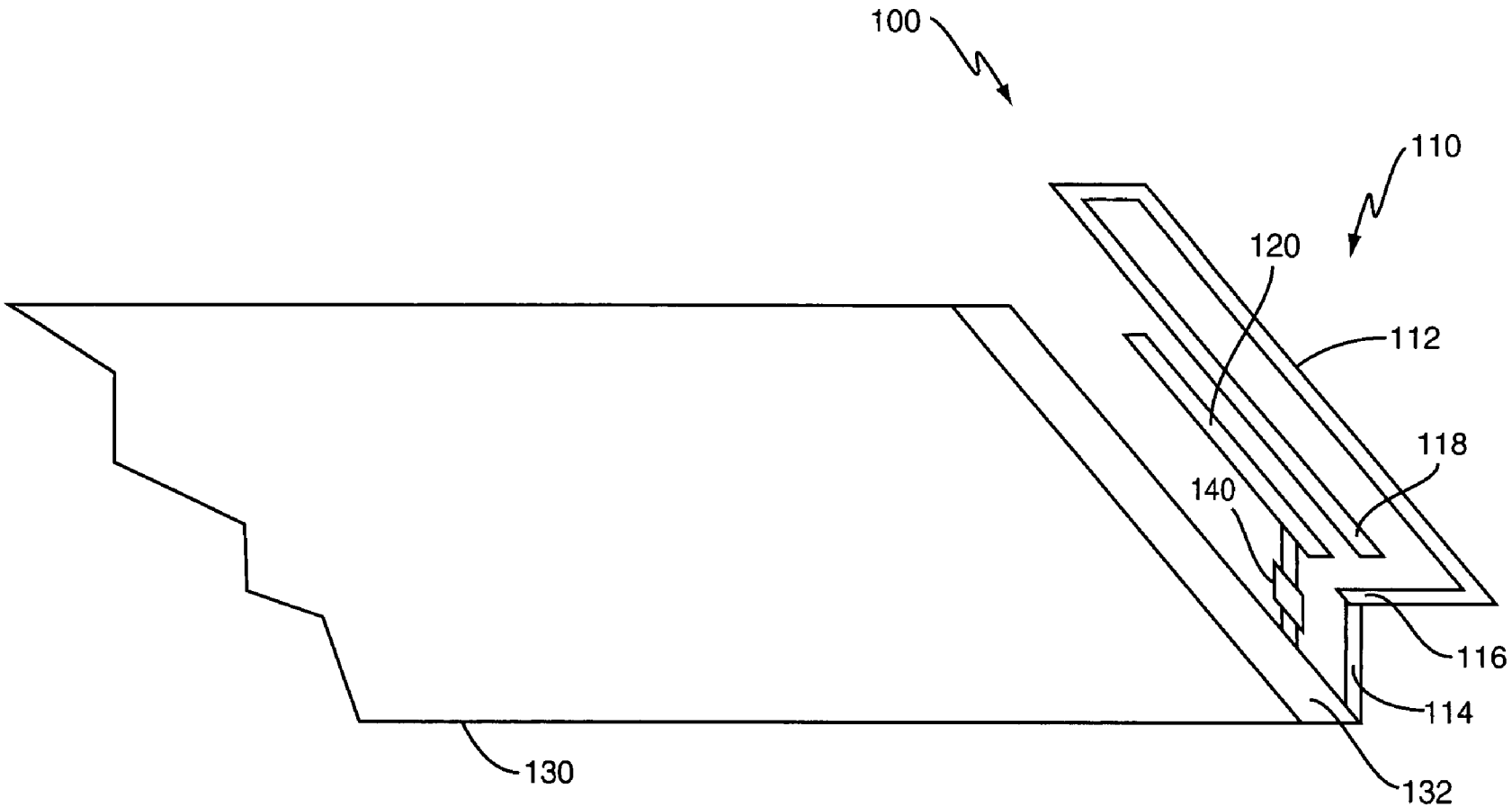
FIG. 2 illustrates an exemplary antenna according to one embodiment of the present invention.
Figure 3:
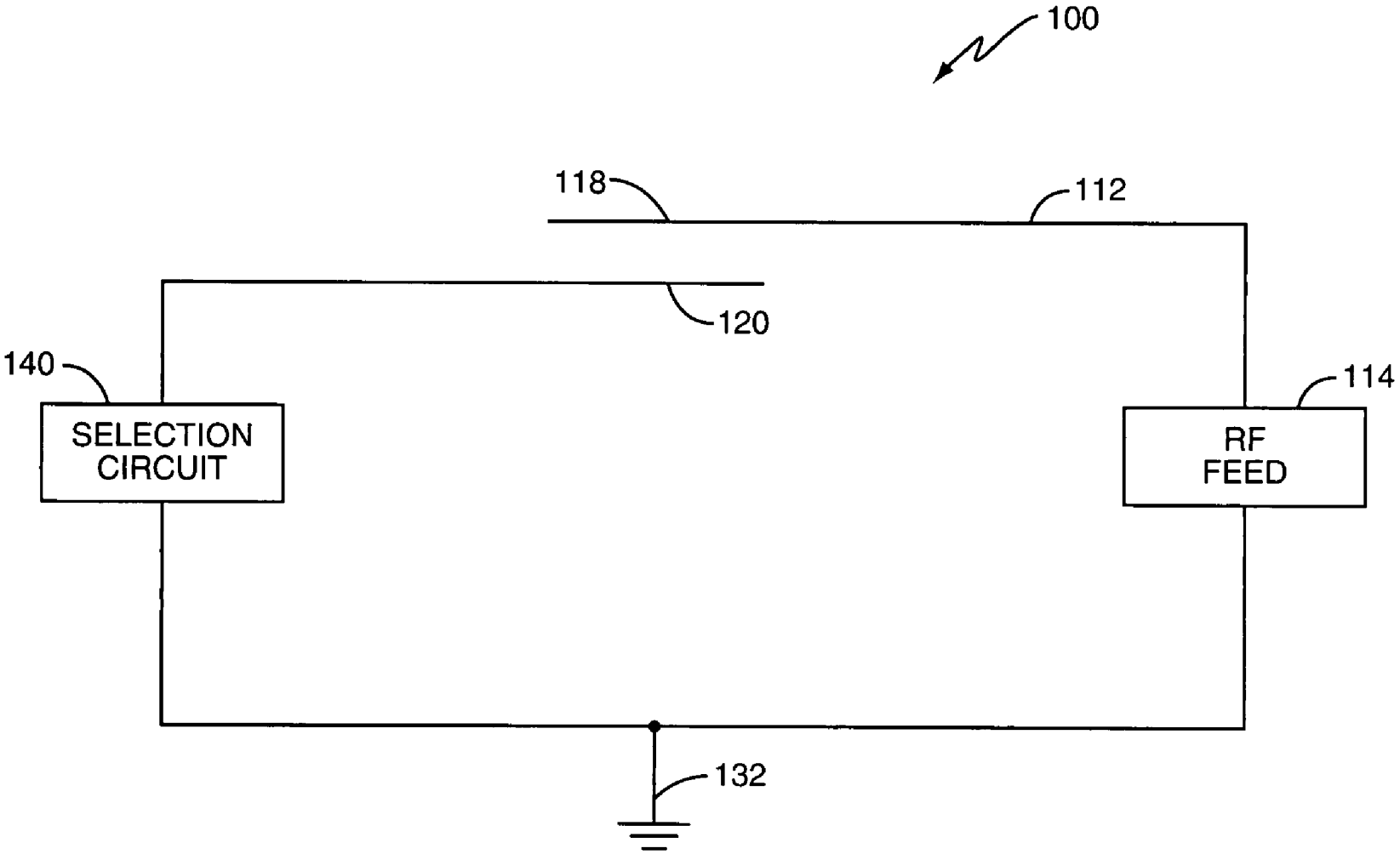
FIG. 3 illustrates a block diagram of the exemplary antenna of FIG. 2.

FIGS. 2 and 3 illustrate a multi-band antenna 100 according to one exemplary embodiment of the present invention. The exemplary multi-band antenna 100 comprises a bent monopole antenna. However, the present invention also applies to other types of antennas, such as a Planar Inverted F-Antenna (PIFA) as described in the co-pending application filed concurrently with the instant application and entitled "Multi-band PIFA" (Attorney Docket No. 2002-204). This application is hereby incorporated by reference.

Antenna 100 comprises a main antenna element 110, a parasitic element 120, and a selection circuit 140. Main antenna element 110 transmits and receives wireless communication signals in the low and high wireless communication frequency bands. Selection circuit 140 selectively couples the parasitic element 120 to a ground 132 of a printed circuit board (PCB) 130 to selectively enable capacitive coupling between the parasitic element 120 and the main antenna element 110 when the antenna 100 operates in the low frequency band. In addition, selection circuit 140 selectively disables the capacitive coupling when the antenna 100 operates in the high frequency band. As a result, selection circuit 140 controls the capacitive coupling between parasitic element 120 and main antenna element 110.

Main antenna element 110 comprises a radiating element 112 elevated from the antenna ground 132 by RF feed 114, where RF feed 114 electrically connects the radiating element 112 to transceiver 50. Radiating element 112 transmits wireless communication signals in one or more frequency bands provided by transceiver 50 via RF feed 114. Further radiating element 112 receives wireless communication signals transmitted in one or more frequency bands and provides the received signals to the transceiver 50 via RF feed 114. According to one embodiment of the present invention, radiating element 112 comprises a feed end 116 connected to the RF feed 114 and a terminal end 118, where the feed end 116 and the terminal end 118 are on opposite ends of the radiating element 112. As shown in FIG. 2, the radiating element 112 is bent along the length of the radiating element 112 to generate the bent monopole shape. According to one exemplary embodiment, radiating element 112 is 40 mm long and 12 mm wide, where the terminal end 116 is 32 mm long, and RF feed 114 positions the radiating element 112 approximately 7 mm from PCB 130.

Parasitic element 120 is disposed generally in the same plane as the radiating element 112 and along terminal end 118 so that the parasitic element 120 runs generally parallel to the terminal end 118. Because of the orientation and location of the parasitic element 120 relative to the terminal end 118, electromagnetic interaction between the terminal end 118 and the parasitic element 120 occurs when selection circuit 140 connects the parasitic element 120 to ground 132. This electromagnetic interaction causes the parasitic element 120 to capacitively couple to the radiating element 112. Generally, this capacitive coupling increases the bandwidth of the low frequency band, but adversely affects operation in the high frequency band. By disconnecting the parasitic element 120 from ground 132 when the antenna 100 operates in the high frequency band, the selection circuit 140 removes the negative effects of the capacitive coupling on the high frequency band.

Selection circuit 140 controls the capacitive coupling between the parasitic element 120 and the radiating element 112 by controlling the connection between the parasitic element 120 and the antenna ground 132. Selection circuit 140 may control the connection between the parasitic element 120 and ground 132 using any means that creates a low impedance connection between the parasitic element 120 and ground 132 when the antenna 100 operates in the low frequency band, and that creates a high impedance connection between the parasitic element 120 and ground 132 when the antenna 100 operates in a high frequency band. In one exemplary embodiment, selection circuit 140 may comprise a switch controlled by controller 20. Closing switch 140 creates a short circuit (low impedance connection) between the parasitic element 120 and the ground 132, while opening switch 140 creates an open circuit (high impedance connection) between the parasitic element 120 and the ground 132.

According to another exemplary embodiment, selection circuit 140 may comprise a frequency dependent lump element circuit, such as a filter 140. By designing the filter 140 to have a low impedance at low frequencies and a high impedance at high frequencies, the filter 140 selectively connects the parasitic element 120 to ground 132 only when the antenna 100 operates in the low frequency band. According to one exemplary embodiment, the selection circuit 140 may comprises an inductance in series with the parasitic element 120, where the inductance ranges between 6.8 nH and 22 nH.

Figure 4:
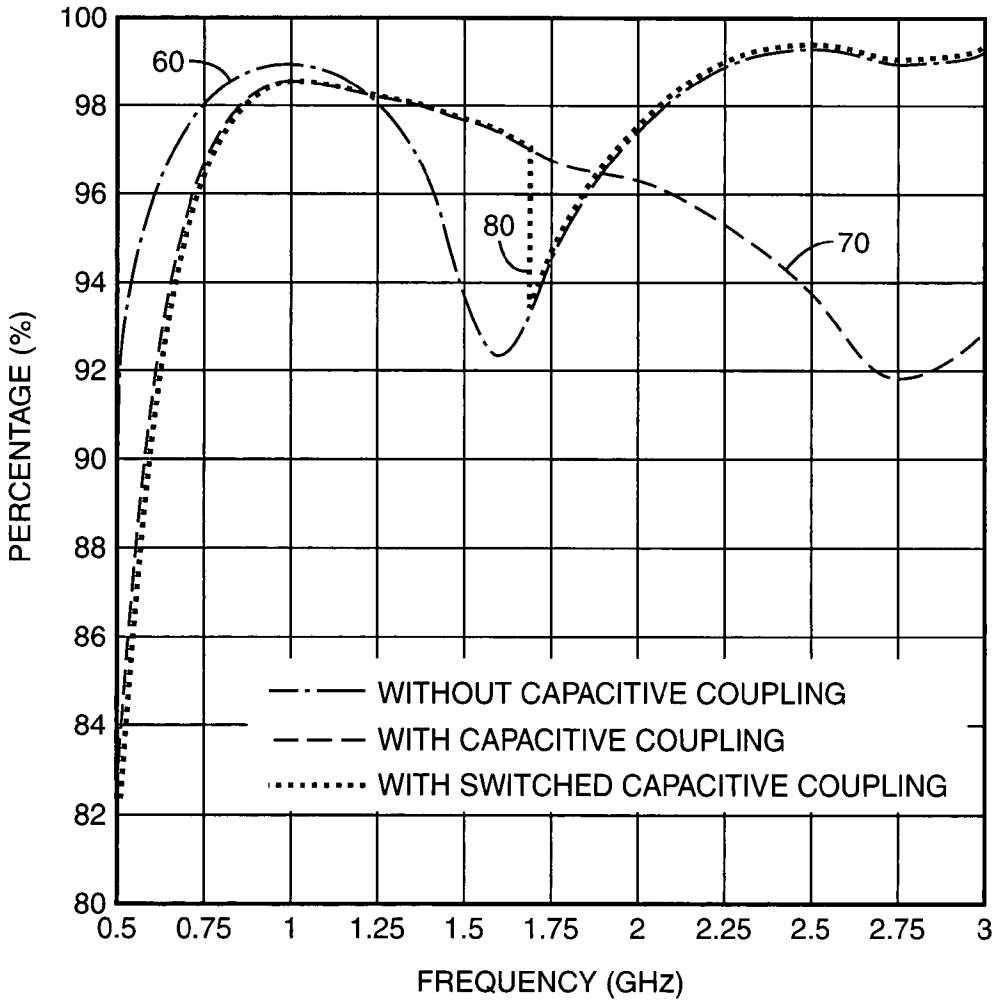
FIG. 4 illustrates an ideal efficiency vs. frequency plot for the antenna of FIGS. 2 and 3.
Figure 5:
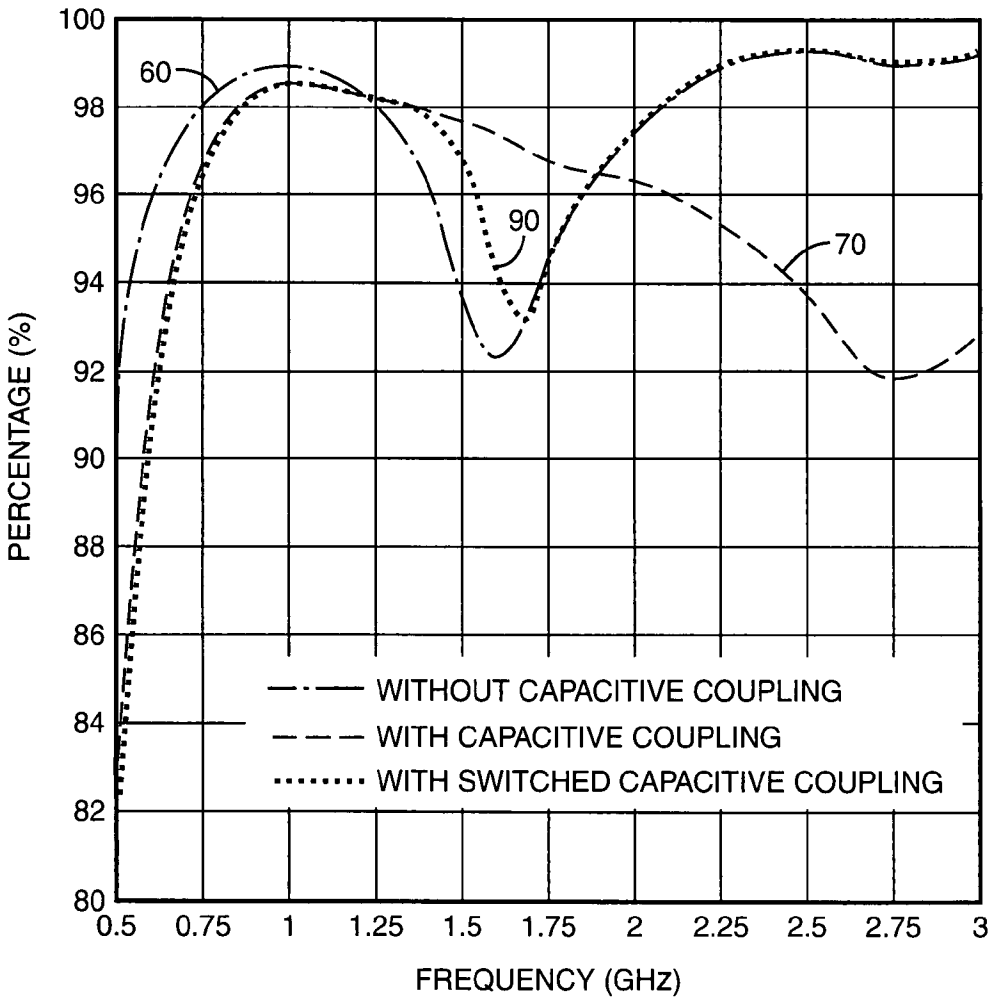
FIG. 5 illustrates another ideal efficiency vs. frequency plot for the antenna of FIGS. 2 and 3.

FIGS. 4 and 5 illustrate the efficiency of the antenna 100 as a function of frequency. The efficiency curves illustrated in these figures represent the simulated efficiency as generated by an electromagnetic simulator, such as Zealand IE3D. As such, these efficiency curves represent an ideal efficiency of the antenna and do not consider dielectric/conductor losses or mismatch losses. Regardless, these efficiency curves accurately represent the effect of the capacitive coupling on the antenna's bandwidth and relative efficiency. Efficiency curve 60 in FIGS. 4 and 5 illustrate the efficiency response of the antenna 100 when the parasitic element 120 is not capacitively coupled to the radiating element 112. The efficiency curve 60 shows that the low frequency band has approximately 0.75 GHz of bandwidth with at least 96% efficiency and a peak efficiency of 99%. Further, efficiency curve 60 shows that more than 1.2 GHz of the high frequency band has at least 96% efficiency and a peak efficiency of 99.5%.

By applying capacitive coupling between the parasitic element 120 and the radiating element 112, antenna 100 increases the field storage inside the radiating element 112, which in turn, increases the bandwidth of the low frequency band. Because the bandwidth is inversely proportional to the efficiency, increasing the bandwidth necessarily decreases the efficiency. For frequencies in the low frequency band, this drop in efficiency is minimal relative to the significant bandwidth increase. However, for frequencies in the high frequency band, the efficiency loss can be significant. Efficiency curve 70 in FIGS. 4 and 5 illustrates these effects. As shown by efficiency curve 70, capacitively coupling the parasitic element 120 to the radiating element 112 reduces the peak efficiency of the low frequency band to 98.5%, but widens the low frequency bandwidth having at least 96% efficiency to approximately 1.25 GHz. However, efficiency curve 70 also illustrates a significant reduction in the high frequency bandwidth and efficiency.

The present invention addresses this problem by selectively applying the capacitive coupling only when the antenna 100 operates in the low frequency band; when the antenna 100 operates in the high frequency band, the capacitive coupling is disabled. Efficiency curve 80 in FIG. 4 illustrates the efficiency of the antenna 100 when the selection circuit 140 comprises a switch 140, while efficiency curve 90 in FIG. 5 illustrates the efficiency of the antenna 100 when the selection circuit 140 comprises a filter 140. In either case, when selection circuit 140 generates a low impedance connection between the parasitic element 120 and the antenna ground 132, efficiency curves 80 and 90 follow curve 70. However, when selection circuit 140 generates a high impedance connection between parasitic element 120 and the antenna ground 132, efficiency curves 80 and 90 follow curve 60. As a result, the low frequency band has increased the bandwidth having at least 96% efficiency to between 0.8 and 0.9 GHz, while the high frequency band has maintained the bandwidth having at least 96% efficiency at more than 1.2 GHz.

As shown in FIG. 4, switch 140 abruptly disables the capacitive coupling at approximately 1.7 GHz. The filter 140, in contrast, gradually disables the capacitive coupling as the impedance approaches 1.7 GHz, as shown in FIG. 5. While the illustrated examples show a cutoff frequency for the capacitive coupling at 1.7 GHz, those skilled in the art will appreciate that antenna 100 may be designed to cutoff the capacitive coupling at any frequency.

The capacitive coupling between the parasitic element 120 and the radiating element 112 may cause a slight shift in the low frequency band resonant frequency. To correct for this shift, RF feed 114 may include matching circuitry that tunes the antenna 100 to relocate the resonant frequency to the pre-capacitive coupling resonant frequency. It will be appreciated that the matching circuit may also be modified to shift the resonant frequency to any desired frequency.

The exemplary embodiment described above increases the bandwidth of the low frequency band without adversely affecting the bandwidth of the high frequency band. However, it will be appreciated that the present invention is not so limited. For example, the parasitic element 120 may be designed to increase the bandwidth of the high frequency band. In this embodiment, selection circuit 140 would be designed and/or controlled to enable capacitive coupling between the parasitic element 120 and the radiating element 112 when the antenna 100 operates in the high frequency band, and to disable the capacitive coupling when the antenna 100 operates in the low frequency band.

Figure 6:
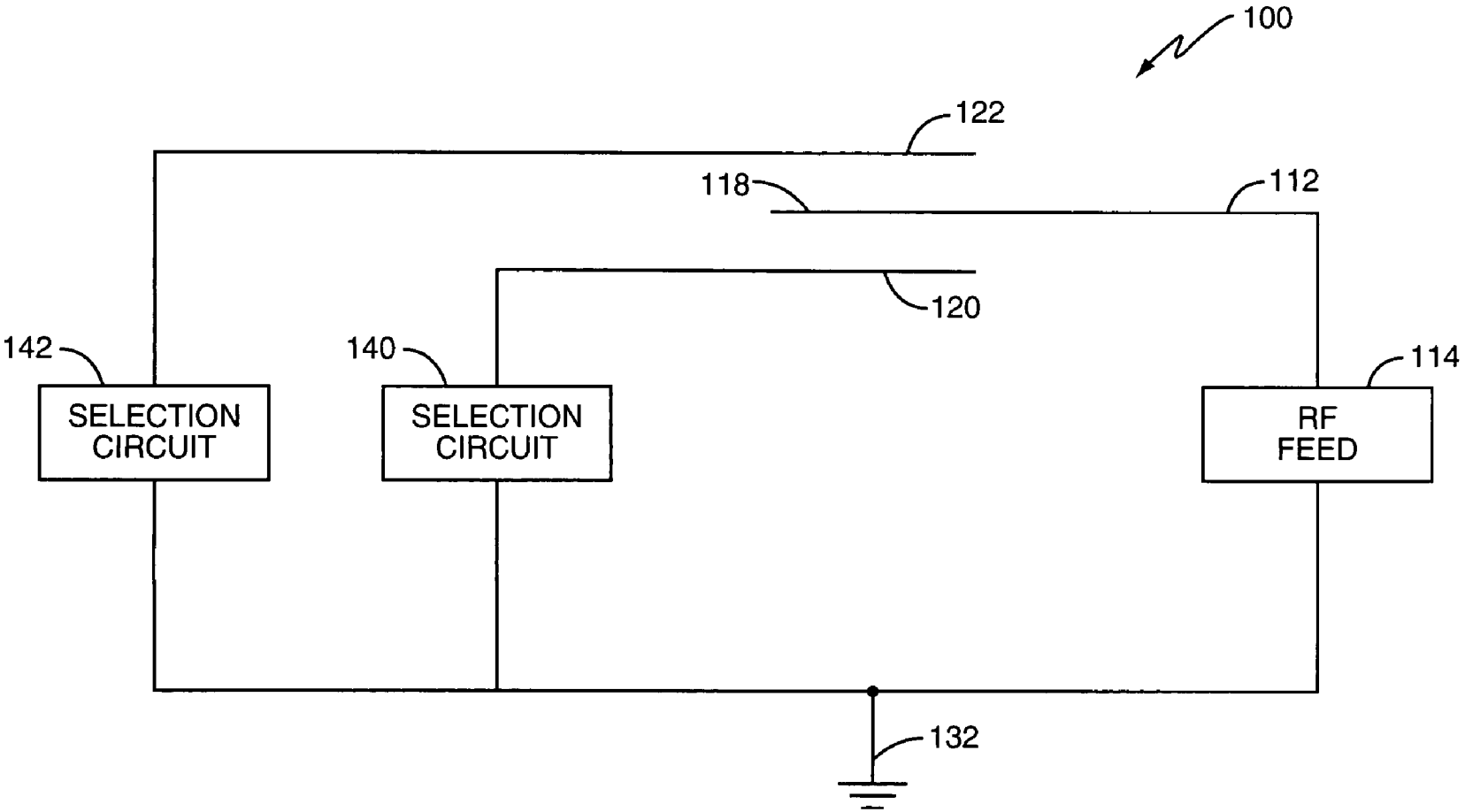
FIG. 6 illustrates a block diagram of an exemplary antenna according to another embodiment of the present invention.

Further, it will be appreciated that antenna 100 may include a low-band parasitic element 120 and a high-band parasitic element 122, as shown in FIG. 6. According to this embodiment, selection circuit 140 enables the low-band capacitive coupling by connecting the low-band parasitic element 120 to ground while selection circuit 142 disconnects the high-band parasitic element 122 from ground during low frequency operation. This increases the low frequency bandwidth when the antenna 100 operates in the low frequency band. When the antenna 100 operates in the high frequency band, selection circuit 142 connects the high-band parasitic element 122 to ground 132 while selection circuit 140 disconnects the low-band parasitic element 120 from ground. This increases the high frequency bandwidth when the antenna 100 operates in the high frequency band.

The present invention improves the bandwidth of at least one frequency band of a compact multi-band antenna 100 without negatively impacting the bandwidth of the remaining frequency bands. As such, the multi-band antenna 100 of the present invention may be used with a wider range of wireless communication standards and/or in a wider range of wireless communication devices 10.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

I claim:

1. A method for increasing a bandwidth of a multi-band antenna comprising:

capacitively coupling a main antenna element to a parasitic element disposed proximate the main antenna element when the multi-band antenna operates in a first frequency band to increase a bandwidth of the first frequency band;

disabling the capacitive coupling when the multi-band antenna operates in the second frequency band; and disposing a filter between the parasitic element and the ground of the main antenna element, wherein the filter has a low impedance responsive to frequencies in the first frequency band so as to capacitively couple the main antenna element to the parasitic element when the multi-band antenna operates in the first frequency band, and wherein the filter has a high impedance responsive to frequencies in the second frequency band so as to disable the capacitive coupling between the main antenna element and the parasitic element when the multi-band antenna operates in the second frequency band.

2. The method of claim 1 further comprising compensating for a resonant frequency shift caused by the capacitive coupling by adjusting an impedance for the main antenna element when the multi-band antenna operates in the first frequency band to maintain a resonant frequency of the first frequency band.

3. The method of claim 1 wherein one of the first and second frequency bands comprises a low frequency wireless communication band, and wherein the other of the first and second frequency bands comprises a high frequency wireless communication band.

4. The method of claim 3 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

5. The method of claim 1 wherein the main antenna element comprises a bent monopole multi-band antenna.

6. The method of claim 1 further comprising:

capacitively coupling the main antenna element to a second parasitic element disposed proximate the main antenna element when the multi-band antenna operates in the second frequency band to increase a bandwidth of the second frequency band; and disabling the capacitive coupling caused by the second parasitic element when the multi-band antenna operates in the first frequency band.

7. A multi-band antenna for a wireless communication device comprising:

a main antenna element;

a parasitic element disposed proximate a portion of the main antenna element; and a filter operatively connected between the parasitic element and a ground of the main antenna element, wherein the filter is configured to enable capacitive coupling between the main antenna element and the parasitic element when the multi-band antenna operates in a first frequency band to increase a bandwidth of the first frequency band, and configured to disable the capacitive coupling when the multi-band antenna operates in a second frequency band.

8. The multi-band antenna of claim 7 further comprising an impedance matching circuit configured to compensate for a resonant frequency shift caused by the capacitive coupling by adjusting an impedance for the main antenna element when the multi-band antenna operates in the first frequency band to maintain a resonant frequency of the first frequency band.

9. The multi-band antenna of claim 7 wherein the filter has a low impedance to enable the capacitive coupling when the multi-band antenna operates in the first frequency band, and wherein the filter has a high impedance to disable the capacitive coupling when the multi-band antenna operates in the second frequency band.

10. The multi-band antenna of claim 7 wherein the main antenna element comprises a radiating element having a feed end and a terminal end.

11. The multi-band antenna of claim 10 wherein the parasitic element is in the same plane as the radiating element.

12. The multi-band antenna of claim 10 wherein a relative orientation of the terminal end is perpendicular to a relative orientation of the feed end.

13. The multi-band antenna of claim 12 wherein the parasitic element is parallel with the terminal end of the radiating element.

14. The multi-band antenna of claim 7 wherein one of the first and second frequency bands comprises a low frequency wireless communication band, and wherein the other of the first and second frequency bands comprises a high frequency wireless communication band.

15. The multi-band antenna of claim 14 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

16. The multi-band antenna of claim 7 further comprising:

a second parasitic element disposed proximate a portion of the main antenna element; and a selection circuit operatively connected to the second parasitic element, wherein the selection circuit is configured to enable capacitive coupling between the main antenna element and the second parasitic element when the multi-band antenna operates in the second frequency band to increase a bandwidth of the second frequency band, and configured to disable the capacitive coupling caused by the second parasitic element when the multi-band antenna operates in the first frequency band.

17. The multi-band antenna of claim 7 wherein the main antenna element comprises a bent monopole antenna.

18. A wireless communication device comprising:

a transceiver configured to transmit and receive wireless signals over a wireless network;

multi-band antenna operatively connected to the transceiver comprising:

a main antenna element;

a parasitic element disposed proximate a portion of the main antenna element; and a filter operatively connected between the parasitic element and a ground of the main antenna element, wherein the filter is configured to enable capacitive coupling between the main antenna element and the parasitic element when the multi-band antenna operates in a first frequency band to increase a bandwidth of the first frequency band, and configured to disable the capacitive coupling when the multi-band antenna operates in a second frequency band.

19. The wireless communication device of claim 18 wherein the multi-band antenna further comprises an impedance matching circuit configured to compensate for a resonant frequency shift caused by the capacitive coupling by adjusting an impedance for the main antenna element when the multi-band antenna operates in the first frequency band to maintain a resonant frequency of the first frequency band.

20. The wireless communication device of claim 18 wherein the filter has a low impedance to enable the capacitive coupling when the multi-band antenna operates in the first frequency band, and wherein the filter has a high impedance to disable the capacitive coupling when the multi-band antenna operates in the second frequency band.

21. The wireless communication device of claim 18 wherein one of the first and second frequency bands comprises a low frequency wireless communication band, and wherein the other of the first and second frequency bands comprises a high frequency wireless communication band.

22. The wireless communication device of claim 21 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

23. The wireless communication device of claim 18 wherein the multi-band antenna further comprises:

a second parasitic element disposed proximate a portion of the main antenna element; and a selection circuit operatively connected to the second parasitic element, wherein the selection circuit is configured to enable capacitive coupling between the main antenna element and the second parasitic element when the multi-band antenna operates in the second frequency band to increase a bandwidth of the second frequency band, and configured to disable the capacitive coupling caused by the second parasitic element when the multi-band antenna operates in the first frequency band.

24. The wireless communication device of claim 18 wherein the main antenna element comprises a bent monopole antenna.

* * * * *